United States Patent [19]

Howard

[11] Patent Number: 4,625,344

[45] Date of Patent: Dec. 2, 1986

[54] PERMANENT SLIP-RESISTANT BATH MAT

[76] Inventor: Timothy J. Howard, P.O. Box 1337, Big Pine Key, Fla. 33043

[21] Appl. No.: 756,287

[22] Filed: Jul. 18, 1985

[51] Int. Cl.[4] ..... A47K 3/02

[52] U.S. Cl. ..... 4/581; 4/582; 4/583

[58] Field of Search ..... 4/581, 583, 582; 428/145, 149, 150

[56] References Cited

U.S. PATENT DOCUMENTS 2,503,174 4/1950 Salvadore ..... 4/581
3,253,293 5/1966 George et al. ..... 4/581
3,836,420 9/1974 Freese ..... 428/145
4,363,145 12/1982 Kawesch ..... 4/583

*Primary Examiner*—Henry K. Artis
*Attorney, Agent, or Firm*—Joseph L. Spiegel

[57] ABSTRACT

A bath mat has a body provided with a coating of adhesive for attaching the mat to the floor of a tub or shower. The body includes a primary layer underlying two layers in which sand particles are embedded in vinyl. Additional vinyl covers the two layers to a substantially uniform thickness while conforming to the underlying rough surface configuration caused by the sand particles. The adhesive has a protective sheet that is removed for installation. The mat is permanently bonded to the tub and provides a durable, slip resistant surface.

5 Claims, 3 Drawing Figures

PERMANENT SLIP-RESISTANT BATH MAT

BACKGROUND OF THE INVENTION (1) Field of the Invention

This invention relates to slip resistant mats of the type designed to be permanently installed on the floor surface of a bath tub or shower and operable under wet conditions to prevent slippage of a person standing on the mat.

(2) Description of Prior Art

The danger and hazard of people being injured by slipping or falling on bath tubs and similar wet slippery devices is well known. Tubs generally have a smooth floor surface rounded at the sides. When such a surface is wet, it is relatively slippery so that a user, when standing thereon or attempting to arise from a sitting position in the tub, has to be nearly perfectly balanced to avoid slipping and falling, with resultant injury.

In the prior art, two general approaches are used to prevent slipping, namely, removable mats and permanently installed appliques. A removable mat is disadvantageous for several reasons. First, its use is optional and people can and do bathe without using the mat. In a commercial environment, this increases the owner's risk of potential liability. Second, a removable mat can be stolen. Third, a removable mat is messy particularly upon removal from the tub while still wet. Water clings to the mat and drips on the floor and other nearby areas. Fourth, such a mat is commonly provided with holes that provide areas which are difficult to clean and which allow germs to breed. Fifth, sometimes water gets under the mat allowing it to shift or slip and thereby defeat the very purpose for which it is designed. Patented examples of such mats are disclosed in U.S. Pat. Nos. 3,418,668—Anderson et al, 3,341,866—Wright and 2,822,553—Florentine.

A commonly used form of permanently installed applique employs a series of strips that are adhesively bonded to the floor surface of a tub at spaced intervals. Under heavy usage, the strips wear out relatively rapidly, the edges curl and the strips have to be replaced two or more times per year. Quite often, the replacing strips have to be set or cure for a period of from several hours to a full day, before the tub can be used. Patented examples of permanently installed slip resistant devices are described in U.S. Pat. Nos. 3,124,811—Treacy and 3,836,420—Friese. Treacy discloses using a plurality of hexagonally shaped ceramic disks or elements adhesively bonded to or embedded in the floor surface. Friese discloses using one or more vinyl appliques having a water resistant adhesive backing. The appliques are ornamentally shaped and have a series of through holes providing a series of edges adapted to grip the feet of a user and prevent slipping. Particulate matter may be impregnated in the applique so as to extend above the upper surface and increase the slip resistance.

SUMMARY OF THE INVENTION

In view of the foregoing, one of the objects of the invention is to provide a novel, durable mat adapted to be permanently installed in a bath tub or the like and providing a highly slip resistant surface while wet.

Another object is to provide a mat that is easy to install and which is immediately available for use right after installation.

Another object is to provide a bath mat which is easy to clean and which will not mildew.

Another object is to provide a translucent or nearly transparent mat which allows the surface of the tub to be seen which also accepts artwork or logos.

Briefly, the invention comprises a flat, flexible mat having a body formed from clear virgin vinyl. The body has a lower surface coated with a clear, water resistant adhesive covered by a protective sheet which is removable at installation time. The body has a primary vinyl layer, the upper portion of which blends into at least one other layer containing clear silica sand particles uniformly coated with vinyl. At least one upper layer containing a relatively uniform layer of vinyl is blended into the lower layer. The top surface of the upper layer provides a high degree of resistance to slippage to a user standing thereon with wet feet.

BRIEF DESCRIPTION OF THE DRAWING

Other objects and advantages of the invention will be apparent from the following description taken in connection with the accompanying drawing wherein.

DESCRIPTION OF THE PREFERRED EMBODIMENTS

Figure 1:
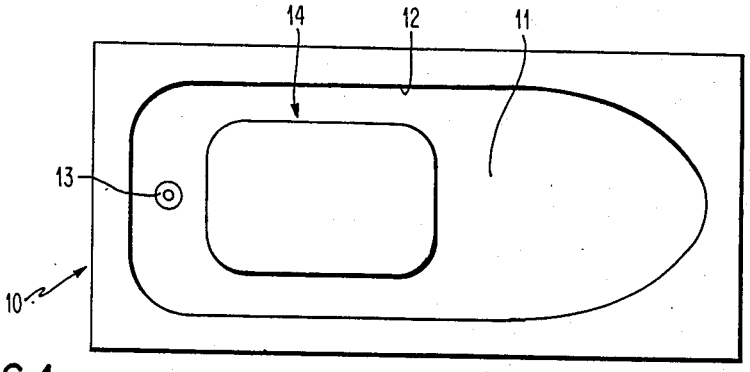
FIG. 1 is a top plan view of a bath tub installed with a mat embodying the invention.

Referring now to the drawing, FIG. 1 shows a conventional bath tub 10 having a floor surface 11 and side walls 12. A drain 13 passes through floor surface 11 near one end of the tub. A mat 14 is permanently attached to tub 10 and covers the area of floor surface 11 on which the user is likely to stand while entering or leaving the tub, taking a shower therein or otherwise. Mat 14 is rectangular in plan view and has rounded corners to preclude corner lift, i.e., the placing of undue stress and wear on sharp corners which would otherwise cause the sharp corners to wear and turn up or prematurely fail before the rest of the mat.

Figure 2:
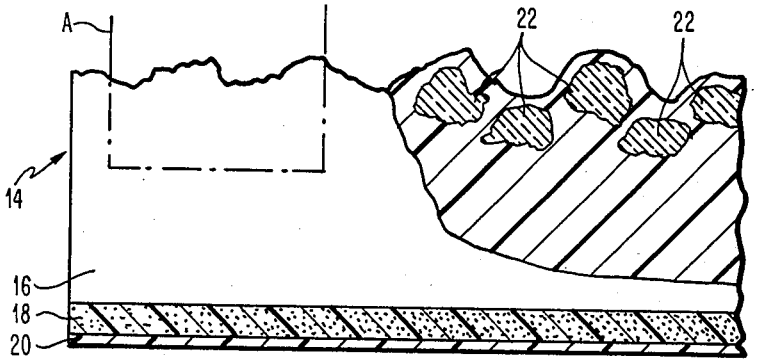
FIG. 2 is an enlarged side elevational view, partly in section, of a mat embodying the invention; and, FIG. 3 is schematic illustration of the area enclosed in reference Box A of FIG. 2, useful in understanding the invention.

As shown in FIG. 2, mat 14 comprises a body 16 the lower surface of which is coated with an adhesive layer 18. The lower surface of layer 18 is covered with a protectiver sheet 20. Such sheet removably adheres to the adhesive layer but is non-sticky so that the mat can be readily handled before installation.

Embedded in body 16 beneath its upper surface are particles 22 of pure silica sand. Such particles are suspended at two different levels as more fully described below. Body 16 is composed of clear, flexible virgin vinyl which is non-yellowing and non-porous. The flexibility allows the body to move or give way when stepped on and then return to its original shape once the user's weight is removed. The sand is colorless and when mixed with the vinyl becomes translucent. Different grit sizes may be used to obtain different surfaces. The adhesive is a clear, water resistant, pressure-sensitive, acrylic based adhesive which, once the mat is installed, forms a permanent bond. The vinyl, sand and adhesive are mixed with the following exemplary (by weight) proportions: 90% vinyl, 5% sand and 5% adhesive. Vinyl inks may be used to color the mat or to form lettering or artwork. The mat, when installed, is clear and glass-like and allows the tub surface, including any coloring or ornamentation, to be seen so that its appearance is not altered.

Figure 3:
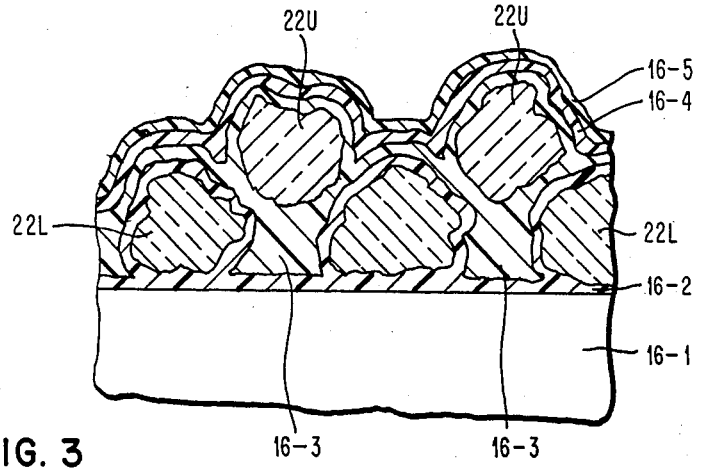

The structure of mat 14 is best explained by considering the manner in which the mat is manufactured. Body 16 is formed with a plurality of layers 16-1 thru 16-5 (FIG. 3). Zone 16-1 provides the primary bulk of mat 14 and is formed from a vinyl sheet having a thickness from 5 to 80 mils, dependent on the desired application. Such sheet is first laminated or coated with adhesive layer 18 and then backed with layer 20. The resultant sheet is then die cut to the desired shape of the finished mat to form a carrier to which the slip resistant materials are applied. At this point, artwork or coloring may be applied to the top surface of the carrier.

Next, silica sand, which has been washed and dried, is mixed with liquid vinyl in a pressurized mixing pot, the relative proportions and size of the particles being chosen in accordance with the texture desired. The mixture is then evenly sprayed on top of layer 16-1 to form layer 16-2. Particles 22L form a first or lower layer of sand embedded in the vinyl which substantially uniformly completely coats particles 22L and the upper surface and layer 16-1. Layer 16-2 is then dried by using ultra violet light. Next, a second layer 16-3 of sand mixed with liquid vinyl is sprayed on top of layer 16-2 whereby second or upper layer of particles 22U is placed over particles 22L, the vinyl sealing and uniformly coating particles 22U and filling any unfilled pockets to keep air from becoming entrapped. Layer 16-3 is then dried by ultra violet light.

A first layer 16-4 of liquid vinyl is then sprayed on top of 16-3 and then dried to form a layer of uniform thickness. A second layer 16-5 of liquid vinyl is then sprayed on top of layer 16-4 and dried to form the upper surface of mat 14 which would be in contact with the feet of a user. All layers of vinyl are applied within an appropriate time period to insure blending and fusing thereof. Each layer is dried by heating to drive off the solvents in the vinyl, the period of heating or drying being effective to nearly completely set up the vinyl and yet not long enough to completely set it before the next layer is applied. This allows the vinyl layers to blend together and fuse to produce a body not subject to delayering. The body is flexible and allows the sand particles suspended therein at different levels, to move without being dislodged when a person steps on or off the mat.

It is obvious to those skilled in the art that various changes can be made in the details of construction and the steps of the manufacturing process, without departing from the scope of the invention as defined in the appended claims.

Having thus described the invention, what is claimed is:

1. A durable bath mat adapted to be permanently secured to the floor of a bath tub or shower and providing a high degree of slip resistance under wet conditions, to a user standing on the mat, comprising:

a layered body having a continuous, unbroken upper surface, said body having a first vinyl layer of a thickness forming the bulk of said mat, at least one second layer on top of said first layer, said second layer comprising sand particles suspended in vinyl, said particles being relatively uniformly laterally spaced and completely surrounded by vinyl whereby said second layer has a relatively rough upper configuration, and at least one third vinyl layer covering said second layer and provided a substantially uniformly thick coating conforming to the configuration of said second layer, said third layer providing a slip resistant surface adapted to support a person standing thereon, said vinyl in all layers being clear, flexible and being blended together to form a solid mass, said first and third layers being free of said sand particles; and, an adhesive layer covering the bottom of said body, said adhesive being clear, permanent and water resistant, and being adapted to adhesively secure said mat to said tub or shower.

2. The combination of claim 1 comprising a fourth layer interposed between said second and third layers, said fourth layer comprising a second layer of sand particles completely covered by vinyl and being suspended above said first mentioned particles.

3. The combination of claim 2 comprising a fifth layer interposed between said fourth and third layers, said fifth layer being only of vinyl and substantially uniformly coating the underlying layer and conforming to the configuration thereof.

4. The combination of claim 1 comprising a peelable protective sheet covering said adhesive and being adapted to be removed to expose said adhesive layer for installation of said mat.

5. The combination of claim 1 wherein said mat is formed with a rectangular shape having rounded corners to prevent corner lift.

* * * * *